United States Patent [19]

Kayes

[11] Patent Number: 4,618,007

[45] Date of Patent: Oct. 21, 1986

[54] IMPACT-ACTION SELF-PROPELLED MECHANISM FOR DRIVING HOLES IN THE EARTH

[75] Inventor: Allan G. Kayes, Sittingbourne, England

[73] Assignee: Pneumatic Punchers Limited, Sittingbourne, England

[21] Appl. No.: 718,868

[22] Filed: Apr. 2, 1985

[51] Int. Cl.[4] ..... E21B 7/26

[52] U.S. Cl. ..... 175/19; 175/296; 173/91

[58] Field of Search ..... 175/19–22, 175/23, 92, 232, 296, 324; 173/91, 135, 138; 91/243

[56] References Cited

U.S. PATENT DOCUMENTS

| | | | |
|---|---|---|---|
| 3,249,124 | 5/1966 | Berryman | 166/331 |
| 3,338,312 | 8/1967 | Scott | 166/331 |

FOREIGN PATENT DOCUMENTS

| | | | |
|---|---|---|---|
| 1170167 | 11/1969 | United Kingdom . | |
| 1261304 | 1/1972 | United Kingdom . | |
| 1301071 | 12/1972 | United Kingdom . | |
| 1392868 | 5/1975 | United Kingdom . | |
| 1438734 | 6/1976 | United Kingdom . | |
| 1482393 | 8/1977 | United Kingdom . | |
| 1526518 | 9/1978 | United Kingdom . | |
| 2066334 | 7/1981 | United Kingdom . | |
| 2111565 | 7/1983 | United Kingdom . | |
| 2141162 | 12/1984 | United Kingdom | 175/296 |

*Primary Examiner*—James A. Leppink
*Assistant Examiner*—Hoang C. Dang
*Attorney, Agent, or Firm*—McAulay, Fields, Fisher, Goldstein & Nissen

[57] ABSTRACT

A pneumatically operated impact-action self-propelled mechanism for driving holes in the earth is disclosed. The mechanism comprises a cylindrical housing with an anvil member located at the forward end thereof. An impact piston is reciprocal in the housing to deliver successive impacts to the anvil member and shapes with the housing a forward chamber of variable volume. A control assembly comprises a forwardly extending sleeve which is slidably received within a rear space of the impact piston to form a rear chamber of variable volume. A central passage is connected to the sleeve for continuous supply of compressed air into the rear chamber and therefrom into the forward chamber through apertures in a side wall of the rear chamber of the impact piston. An arrangement is provided for lockably locating the sleeve longitudinally with respect to the apertures for providing forward or reverse movement of the mechanism.

3 Claims, 4 Drawing Figures

IMPACT-ACTION SELF-PROPELLED MECHANISM FOR DRIVING HOLES IN THE EARTH

This invention relates to an impact-action self-propelled mechanism for driving holes in the earth by compacting the soil about the hole being made, such mechanism being pneumatically driven.

It is an object of the invention to provide a simple and easy to operate control mechanism for providing reverse action of such a mechanism when it is to be removed from a hole being driven.

According to the invention there is provided a pneumatically operated impact-action self-propelled mechanism for driving holes in the earth comprising a cylindrical housing with an anvil member located at the forward end thereof; an impact piston reciprocal in the housing to deliver successive impacts to the anvil member and shaping with the housing a forward chamber of variable volume; a control assembly comprising a forwardly extending sleeve which is slidably received within a rear space of said impact piston to form a rear chamber of variable volume, a central passage connected to said sleeve for continuous supply of compressed air into said rear chamber and therefrom into said forward chamber through apertures in a side wall of the rear chamber of said impact piston; and means for lockably locating said sleeve longitudinally with respect to said apertures for providing forward or reverse movement of said mechanism.

The control assembly may be formed such that said sleeve is connected to a rearwardly extending cylindrical member carrying a pin extending diametrically therefrom to engage in a generally "Z-shaped" slot formed in a further cylinder which partially surrounds said rearwardly extending cylinder and is located in a fixed position relative to the housing, the rearwardly extending cylinder being normally resiliently urged in a forward direction for providing forward motion of the mechanism and being lockable in a rearward location relative thereto for providing rearward motion of the mechanism.

A screw threaded member may extend forwardly of the housing for carrying any one of the different attachments thereon.

The rear of the housing or a member attached thereto may be internally screw-threaded for locating various attachments therein, for example, pulling attachments.

The foregoing and further features of the invention may be more readily understood from the following description of a preferred embodiment thereof, by way of example, with reference to the accompanying drawings, in which.

Figure 1:
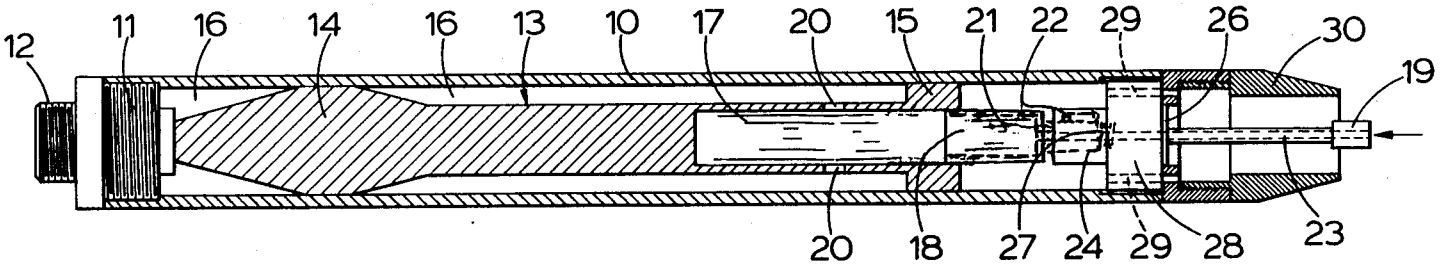
FIG. 1 is a side sectional schematic view of a pneumatically operated impact-action self-propelled mechanism.

Referring now firstly to FIG. 1 the mechanism comprises a cylindrical housing 10 having an anvil 11 located at the forward end and a screw-threaded member 12 outwardly thereof for receiving forward attachments.

An impact piston 13 engages the internal cylindrical wall of the housing 10 with an interrupted annular shoulder 14 and a continuous annular shoulder 15.

The space between the internal wall of the housing 10 and the external surface of the impact piston 13 constitutes a front working chamber 16. The rear portion of the impact piston 13 has formed therein a cavity 17 which receives a forwardly extending sleeve 18 which is connected to an air supply connector 19. The cavity 17 constitutes the rear working chamber of the mechanism, responsible for forward displacement of the impact piston 13. Ports 20 are formed through the cylindrical wall of the impact piston 13 in the area of the rear cavity 17, these ports 20 establishing communication between chambers 16 and 17.

Figure 2:
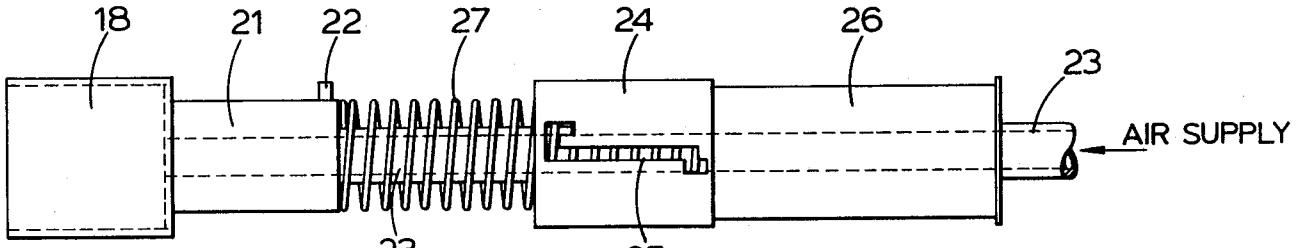
FIG. 2 is a diagrammatic partially exploded side sectional view of a control assembly as located in the mechanism of FIG. 1 on an enlarged scale.

Referring now also to FIG. 2, which illustrates the elements comprising the control assembly in partially exploded relationship for illustrative purposes, the sleeve 18 is attached to and carried by a rearwardly extending cylindrical member 21 carrying a pin 22 extending diametrically therefrom and having an air supply tube 23 connected to the air supply connector 19, passing therethrough. A further cylindrical member 24 is formed with a generally "Z-shaped" slot 25 into which the pin 22 engages when the member 24 surrounds the member 21. The member 24 is carried by a further cylindrical member 26 which houses a spring 27 for normally urging the member 21 in a forward direction. The member 26 is attached within the housing 10 by a bushing 28 which is formed with longitudinally extending apertures 29.

The rear internal surface of the housing 10 is screw-threaded at 30 to receive various attachments such as a cone-shaped attachment for reverse movement of the mechanism or, for example, for attachment of pulling means.

Figure 3:
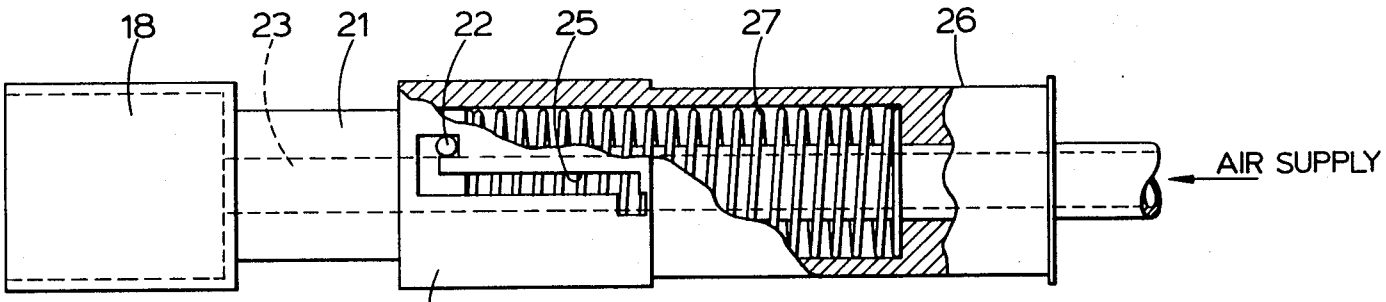
FIG. 3 is a side sectional view of the control assembly located in the position for forward movement of the mechanism.

In operation of the mechanism, with the control assembly in the position as shown in FIG. 3 and with compressed air supply to the connector 19, such compressed air is fed through a supply tube 23 to the working chamber 17. This causes the impact piston 13 to be driven forwardly to engage the anvil 11, which impact causes the housing 10 to be driven forwardly.

At a pre-set point, immediately preceding the point at which the impact piston 13 strikes the anvil 11 (this pre-set point being defined by the position of the ports 20 in the impact piston 13 and by the arrangement of the head portion of the sleeve 18, the ports 20 establish communication between the chambers 16 and 17, whereby the front chamber 16 becomes connected with the source of compressed air via the rear chamber 17, the supply tube 23 and the connector 19.

The rebound of the impact member after an impact, together with the force exerted by the compressed air on the forward face of the impact piston, due to the difference between the working (effective) areas of the impact piston 13 in the chambers 16 and 17, respectively, are responsible for the return stroke of the impact piston after it has delivered the impact upon the anvil 11.

In the course of this return stroke of the impact piston 13, the ports 20 become closed by the external cylindrical wall of the head portion of the sleeve 18 and during the rest of the return stroke the compressed air in the working chamber 16 is expanding. At this stage of its return stroke the motion of the impact piston 13 meets the resistance of the compressed air in chamber 17 which is continuously connected with the source of compressed air.

At the end of the return stroke of the impact piston 13, the ports 20 thereof pass beyond the head portion of the sleeve 18 and thus establish communication between the working chamber 16 and the ambient atmosphere through the exhaust passages 29.

Then the above-described operating cycle repeats itself.

Figure 4:
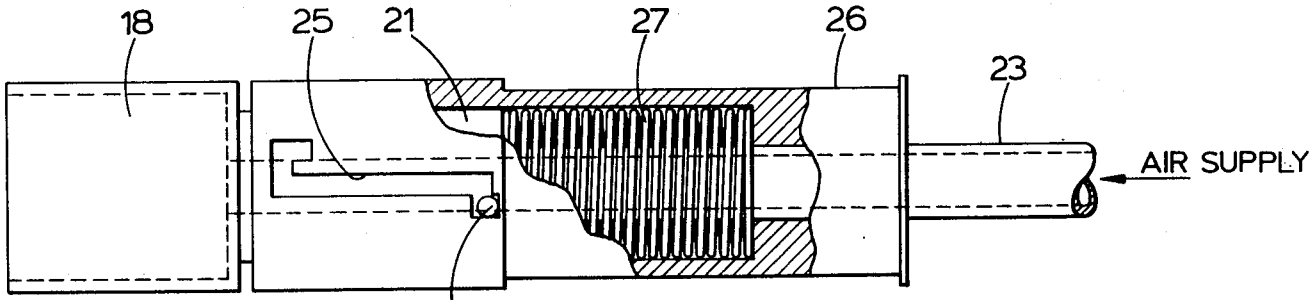
FIG. 4 is a side sectional view of the control assembly located in the position for rearward movement of the mechanism.

When it is required to reverse the mechanism out of the hole formed the air supply is turned off and the hose rotated clockwise, pulled and rotated clockwise again so as to move the cylinder 24 from the position shown in FIG. 3 to the position shown in FIG. 4. In this position the sleeve 18 is located rearwardly in chamber 17 and the apertures 20 remain open. When the air supply is turned on the impact piston 13 is driven rearwardly to move the mechanism rearwardly.

When it is required to drive the mechanism forwardly again the air supply is again turned off and the hose rotated in an anti-clockwise direction, the action of the spring 27 returning the member 21 and sleeve 18 to the position shown in FIG. 3.

I claim:

1. A pneumatically operated impact-action self-propelled mechanism for driving holes in the earth comprising a cylindrical housing having a forward and a rear end and an anvil member located at the forward end; an impact piston reciprocal in the housing to deliver successive impacts to the anvil member and forming within the housing a forward chamber of variable volume; said impact piston having a rear space defined by a rearwardly extending side wall; a control assembly comprising a forwardly extending sleeve which is slidably received within the rear space of said impact piston to form a rear chamber of variable volume; a tube having connecting means for connection to a compressed air supply and a central passage connected to said sleeve for continuous supply of compressed air into said rear chamber and therefrom into said forward chamber through apertures in the side wall of the rear chamber of said impact piston; and means for lockably locating said sleeve longitudinally with respect to said apertures for providing forward or reverse movement of said mechanism, said control assembly further comprising a rearwardly extending cylindrical member connected to said sleeve and tube, said cylndrical member carrying a pin extending diametrically therefrom to engage in a generally Z-shaped slot formed in a further cylinder which partially surrounds said rearwardly extending cylindrical member and is located in a fixed position relative to the housing, the rearwardly extending cylindrical member being normally resiliently urged in a forward direction for providing forward motion of the mechanism, and being lockable by rotation of said tube in a rearward location relative thereto for providing rearward motion of the mechanism.

2. A mechanism as claimed in claim 1, wherein a screw-threaded member extends forwardly of the housing for carrying any one of a plurality of different attachments thereon.

3. A mechanism as claimed in claim 1, wherein the rear of the housing is internally screw-threaded for locating various attachments therein, for example, pulling attachments.

* * * * *